US007144313B1

(12) United States Patent
Greenwood

(10) Patent No.: US 7,144,313 B1
(45) Date of Patent: Dec. 5, 2006

(54) ABRASIVE SHEET ALIGNMENT DISPENSER

(76) Inventor: Tim R. Greenwood, 11437 Kyle Rd., Garrettsville, OH (US) 44231

( * ) Notice: Subject to any disclaimer, the term of this patent is extended or adjusted under 35 U.S.C. 154(b) by 0 days.

(21) Appl. No.: 10/742,219

(22) Filed: Dec. 19, 2003

(51) Int. Cl.
*B24B 19/00* (2006.01)

(52) U.S. Cl. ..... 451/458; 206/443

(58) Field of Classification Search ..... 451/428, 451/458; 206/443, 493
See application file for complete search history.

(56) References Cited

U.S. PATENT DOCUMENTS 3,280,987 A * 10/1966 Steinbock ..... 211/59.1
3,677,866 A * 7/1972 Pickett et al. ..... 206/306
3,849,949 A 11/1974 Steinhauser
4,516,678 A * 5/1985 Fotiadis et al. ..... 206/308.3
4,875,259 A 10/1989 Appeldorn
4,920,702 A 5/1990 Kloss
5,201,101 A 4/1993 Rouser
5,377,455 A 1/1995 Lanzer
5,409,114 A * 4/1995 Myers et al. ..... 206/394
6,050,887 A * 4/2000 Chang ..... 451/458
6,193,337 B1 2/2001 Roeker
6,264,534 B1 * 7/2001 Panyard et al. ..... 451/11
6,663,478 B1 * 12/2003 Ulrich ..... 451/458

FOREIGN PATENT DOCUMENTS

WO WO96/38264 12/1996

* cited by examiner

*Primary Examiner*—M. Rachuba

(57) ABSTRACT

An abrasive sheet dispenser for aligning and attaching hook and loop backed abrasive sheets onto abrading tools, which utilize vacuum holes incorporated into the backup pad and into its corresponding abrasive sheet. In a preferred embodiment, the dispenser has an injection molded universal base having a plurality of guide hole locations. Each group of guide hole locations is connected by a guide screw channel. The dispenser has a plurality of injection mold guides and a plurality of guide screws. The guides are of a height as to support a plurality of abrasive sheets and fastened onto the universal base by inserting the guide screws through the guide holes in the universal base from underneath and screwing into the bottom center of guides. The guides are adjustable allowing them to be aligned with various vacuum hole patterns and sizes of abrasive sheets by sliding each guide along the guide screw channel to another guide hole location within that group. The dispenser also has an injection molded clear acrylic universal cover plate, which is placed over the stack of abrasive sheets as a protective dust and moisture cover.

4 Claims, 11 Drawing Sheets

ABRASIVE SHEET ALIGNMENT DISPENSER

BACKGROUND OF THE INVENTION

The present invention relates to a dispenser for attaching abrasive sheets to a backup pad, and more particularly to a dispenser that conveniently aligns the vacuum holes in an abrasive sheet with the vacuum holes in the backup pad, as well as centering the abrasive sheet onto the backup pad.

Abrasives are commonly used to grind, sand, and polish materials such as wood, metal, paint, and plastic. One method of abrading a work piece is to affix an abrasive sheet to a backup pad, and to rotate the backup pad while urging the abrasive against a workpiece. In many applications, the abrasive sheet and the backup pad are circular, although other configurations are also known, For example, U.S. Pat. No. 4,920,702 (Kloss et al.) discloses a portable grinder having, in one embodiment, a generally triangular backup pad and abrasive sheet that are vibrated rather than rotated.

The abrasive sheet may be affixed to the backup pad in a number of different ways. For example, the use of a pressure sensitive adhesive (see e.g., U.S. Pat. No. 3,849,949 (Steinhauser et al.), interengaging fastener members, such as hook portions on the backup pad and loop fabric on the abrasive sheet (see e.g., U.S. Pat. No. 4,875,259 (Appeldorn) or U.S. Pat. No. 5,201,101 (Rouser et al.) and cooperating male and female fastener members, are known in the art.

The backup pad may be configured to be hand held, or may be configured for attachment to a powered abrading apparatus. A typical abrading apparatus includes a rotating output shaft that is powered by an abrading head. These abrading apparatuses, alternatively referred to as grinders herein, may be electrically or pneumatically powered, and typically rotate the backup pad at speeds between 3,000 and 20,000 revolutions per minute. The abrading apparatus may be one of several types. For example, a rotary grinder simply rotates the backup pad and attached abrasive sheet about a fixed axis. A random orbital grinder combines a rotary and orbital motion that results in a random motion of the backup pad with respect to the abrading head.

The abrading apparatus can also have dust collection holes incorporated into the backup pad. An abrasive sheet is then desired which also has vacuum holes. This system causes the dust to be drawn away from the abrading area through the vacuum holes. The abrading tool has an attached container in which the dust is collected or may be attached by hose to a separate dust collector.

The diameter of the abrasive sheet is typically larger than the diameter of the backup pad (for example, a 127 mm sheet and a 124 mm pad), to permit abrading near the periphery of the abrasive sheet without damage to the backup pad or to the surface being abraded. It is desirable to position the abrasive sheet relative to the backup pad so that the sheet extends beyond the backup pad around its entire circumference without any of the support of the backup pad exposed. It is also desirable to center the abrasive sheet relative to the backup pad so that the amount by which the sheet extends beyond the backup pad is relatively constant along the periphery of the sheet. In the case of a dust collection system the vacuum holes must be aligned as well in order for the dust to be extracted properly. Typically, the operator of the apparatus applies the abrasive sheet by hand while attempting to center it and align the vacuum holes as well as possible. It is also known to program robotic sanders to attach abrasive sheets centered on the backup pad (see U.S. Pat. No. 5,377,455 (Lanzer)).

In the case of through the pad dust extraction, the abrading tool is turned over to expose the backup pad. The vacuum holes of an abrasive sheet are then visually lined up with the vacuum holes of the backup pad. The tool is then turned right side up for continued use.

Various dispensers for abrasive articles are known, such as those disclosed in U.S. Pat. No. 3,849,949 (Steinhauser et. Al.), WIPO International Patent Application Publication No. WO96/38264 (King et al.) and U.S. Pat. No. 6,193,337 (Roeker, et al.) However, these dispensers do not provide a way to align the vacuum holes in abrasive sheets with the vacuum holes in a backup pad.

It is desirable to provide an abrasive sheet dispenser that simply, quickly and effectively centers and aligns vacuum hole abrasive sheets onto a vacuum hole backup pad.

SUMMARY OF THE INVENTION

An abrasive sheet dispenser having multiple upstanding adjustable alignment guides for registration with selective apertures in abrasive sheets. The alignment guides provide corresponding registration with vacuum inducing openings in a back pad and support base of an abrading tool to evacuate abraded material from the work surface. The abrasive sheets have an inner attachment surface for selectively securing to corresponding effacing surface of the back up pad.

It is an object of the vacuum apertured abrasion sheet dispenser of this invention to provide for orderly contained stack of vacuum hole abrasive sheets easily identified, aligned and applied onto an abrading tool in a minimum amount of time.

In one preferred embodiment, the above dispenser comprises a unitary molded plastic base and guides.

In another preferred embodiment, the above dispenser has internal springs allowing the guides to retract into and protract out of the base.

In another preferred embodiment, the above dispenser has nutational notches at spaced locations on the guides.

In another preferred embodiment, the above dispenser further includes a protective cover.

In another preferred embodiment, the above dispenser has a riser plate, a riser spring, and a protective cover.

In another preferred embodiment, the above dispenser comprises a thermoformed package having a plurality of guides thermoformed inside of the cover.

In another preferred embodiment, the above dispenser has a single notch below the tip of each guide to receive a lock-down cover plate.

In another preferred embodiment, the above dispenser has a plurality of adjustable guides, each having a bottom flange allowing movement within enlarged guide holes without falling out through the top with a bottom retainer plate.

In another preferred embodiment, the above dispenser further includes several alternative guide locations allowing one dispenser to be interchangeable with more than one vacuum-hole pattern and size abrasive sheet by using adjustable guides selectively repositionable within pre-defined travel paths within the base without having to remove the guides.

In another preferred embodiment, the above dispenser further includes a universal cover plate.

In another preferred embodiment, the above dispenser further includes a multi-unit storage case.

DETAILED DESCRIPTION OF THE INVENTION

Figure 1:
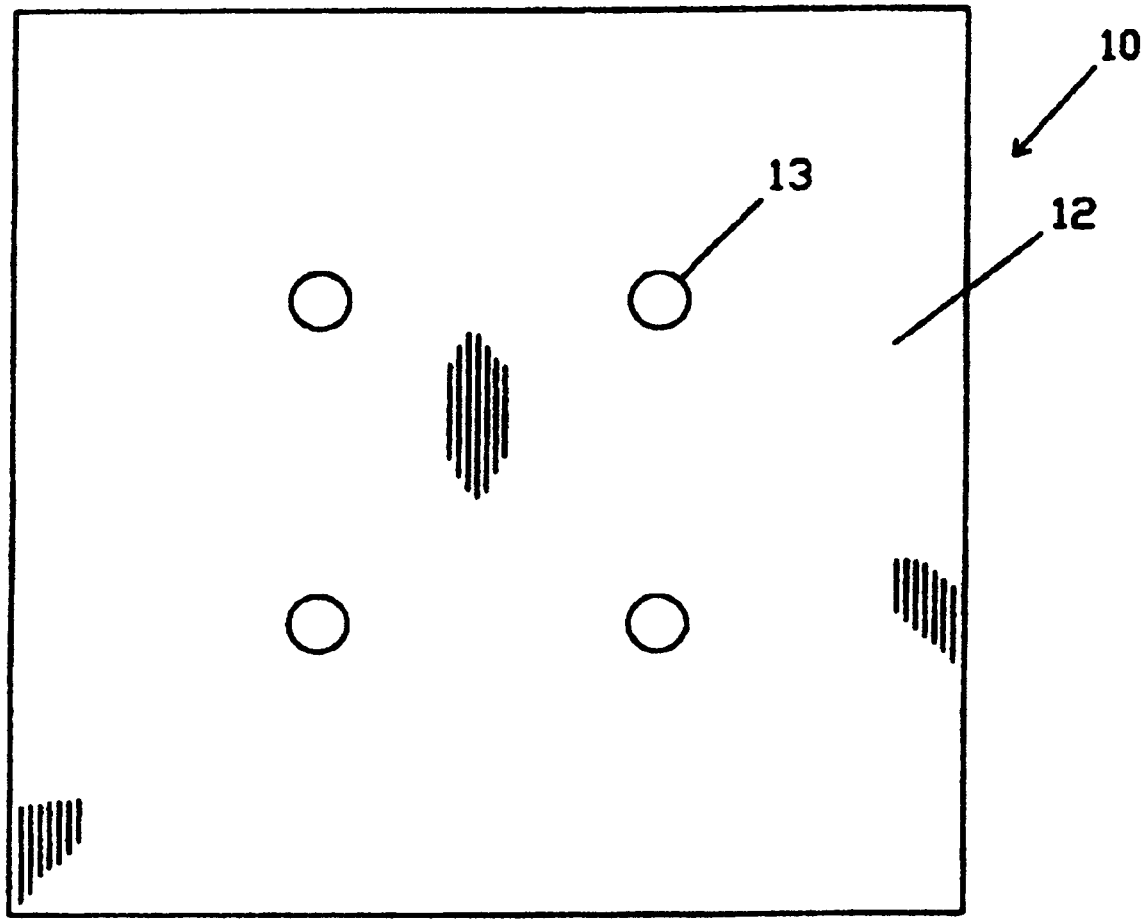
FIG. 1 is a top plan view of a preferred embodiment of a dispenser according to the present invention.
Figure 2:
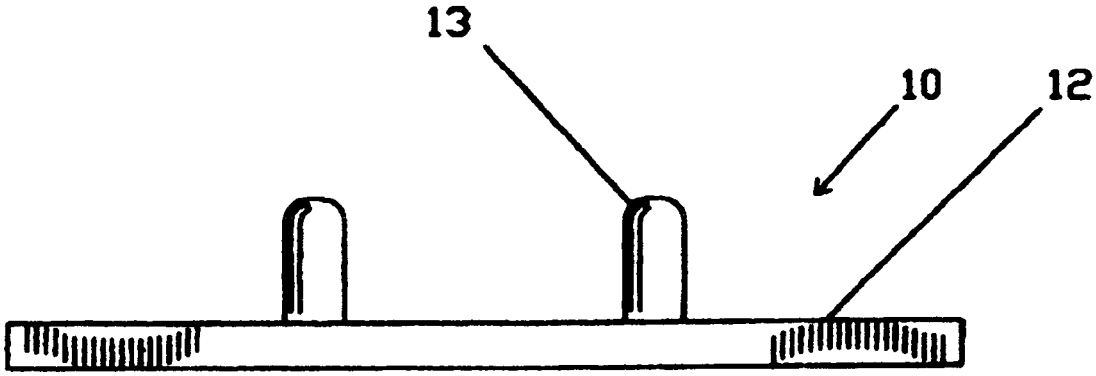
FIG. 2 is a front elevational view of the dispenser of FIG. 1
Figure 3:
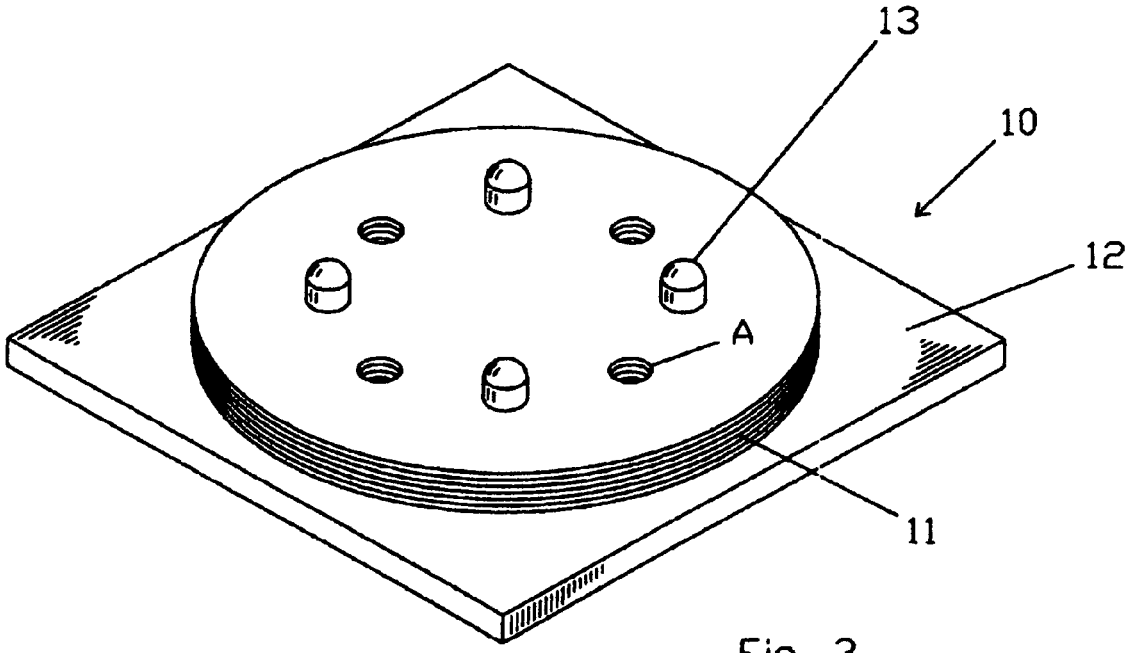
FIG. 3 is an isometric view of the dispenser of FIG. 1 containing a plurality of abrasive sheets.

Referring to FIGS. 1–3 of the drawings, there is shown therein a first preferred embodiment of a dispenser 10 according to the present invention. The dispenser 10 is designed to hold a plurality of vacuum-hole abrasive sheets 11 for attachment to a corresponding backup pad, not shown. The dispenser 10 is configured to allow for convenient bench top operation. It is also configured to center the backup pad onto an abrasive sheet 11 such that the amount the sheet extends beyond the backup pad around the periphery is generally constant and uniform as will be well understood by those skilled in the art.

The dispenser 10 includes a base 12 and a plurality of elongated upstanding guides 13. Base 12 and guides 13 may be molded such as by injection molding a unitary base and guides out of a suitable material such as plastic.

Base 12 is typically 1/16" thick and can be square, round, or may simulate the shape of its intended abrasive sheet. The length and width of base 12 is determined by its intended abrasive sheet 11. An exposed outer periphery of base 12 beyond its intended abrasive sheet 11 is preferred to ease in holding dispenser 10 stationary. During use, the dispenser 10 of the invention is designed to be an insert included in abrasive packaging used within the art such as paper boxes and thermoformed packages as a free accessory applicator and may be produced in a variety of colors to encourage easy grit identification.

The position of guides 13 on base 12 is determined by the aperture orientation intended abrasive sheet 11 to be dispensed. Therefore, various models of a dispenser 10, according to the present invention having different spacings of guides 13 are desired of such as to accommodate such vacuum-hole configurations. The number of guides 13 may equal the number of vacuum holes in its intended abrasive sheet 11 and can, as an option, be reduced to a minimum desired number of no less than two guides 13. The diameter of guides 13 is of such as to fit snugly within the vacuum holes A of its intended abrasive sheet 11 without being restrictive. The length of guides 13 is of such as to allow the intended backup pad, not shown, to seat fully down to base 12.

Figure 4:
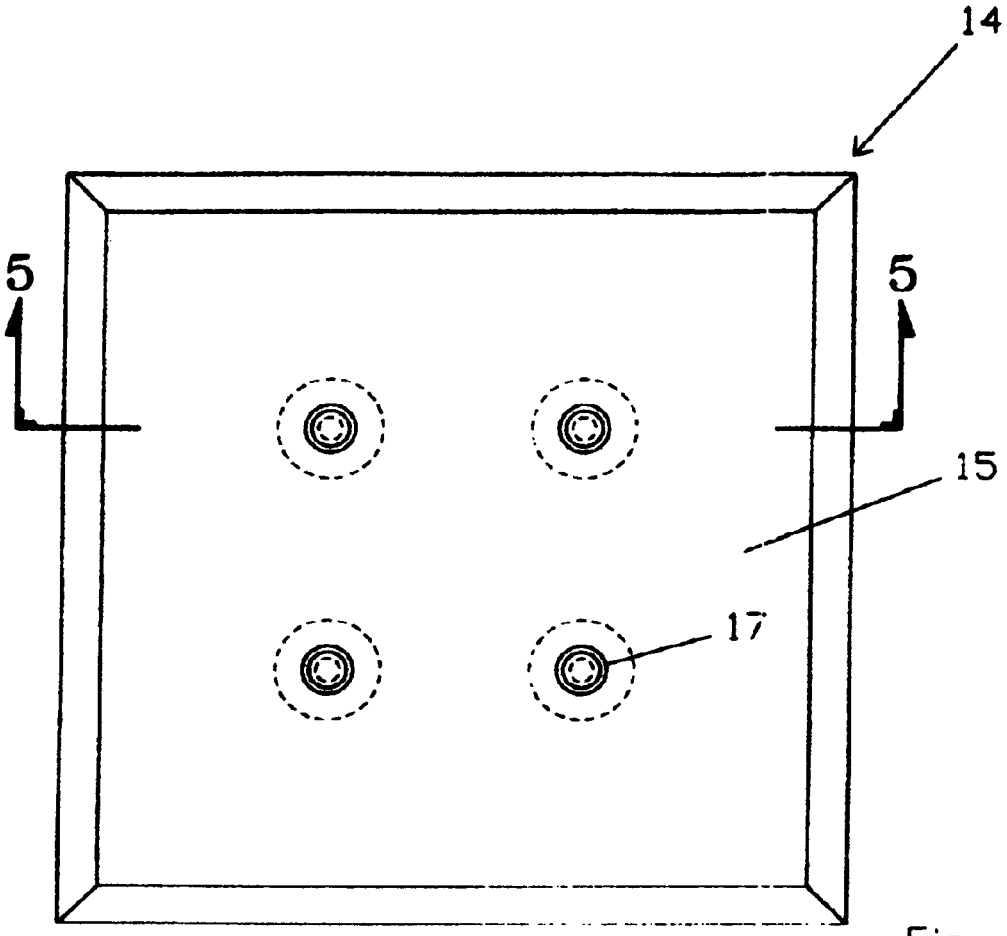
FIG. 4 is a top plan view of an alternate embodiment of a dispenser according to the present invention.
Figure 5:
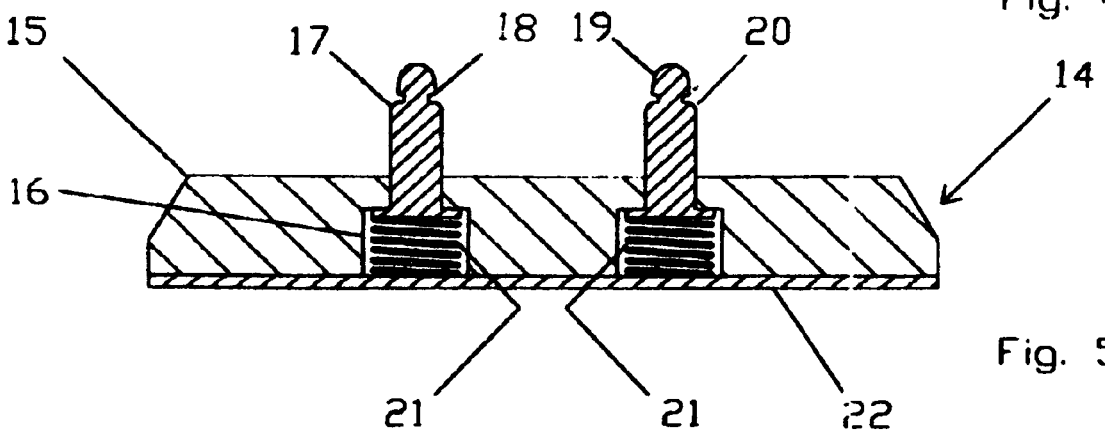
FIG. 5 is a cross-section view on lines 5—5 of FIG. 4.

Referring to FIGS. 4 and 5 of the drawings, there is shown therein a second preferred embodiment of a dispenser 14 according to the present invention. The dispenser 14 includes a base 15, having a plurality of guide wells 16, a plurality of elongated guides 17, each having a single notch 18, and a smaller tip 19, above the notch, a shoulder 20, a plurality of guide well-springs 21, a bottom cover 22, and a locking cover plate 23, (shown FIG. 15 of the drawings). Base 15 is typically ¾" thick and can be molded out of a suitable material, such as plastic. Guides 17 can be molded out of a suitable material, such as plastic. Guides 17 retract under pressure and protract when pressure is released. The springs 21 are approximately ½" long, ⅜" in diameter. A plurality of tapered slots 24, in locking cover plate 23 are of a configuration as to fit over the tips 19, of guides 17, allowing cover plate 23, to seat onto larger shoulder 20, of guide 17, even with notch 18. Cover plate 23 can then be rotated into a locking position within notch 18, as shown. During assembly, guides 17 are inserted into guide wells 16, from the bottom.

Guide well springs 21, are then placed into guide wells 16 and bottom cover 16A installed.

Figure 6:
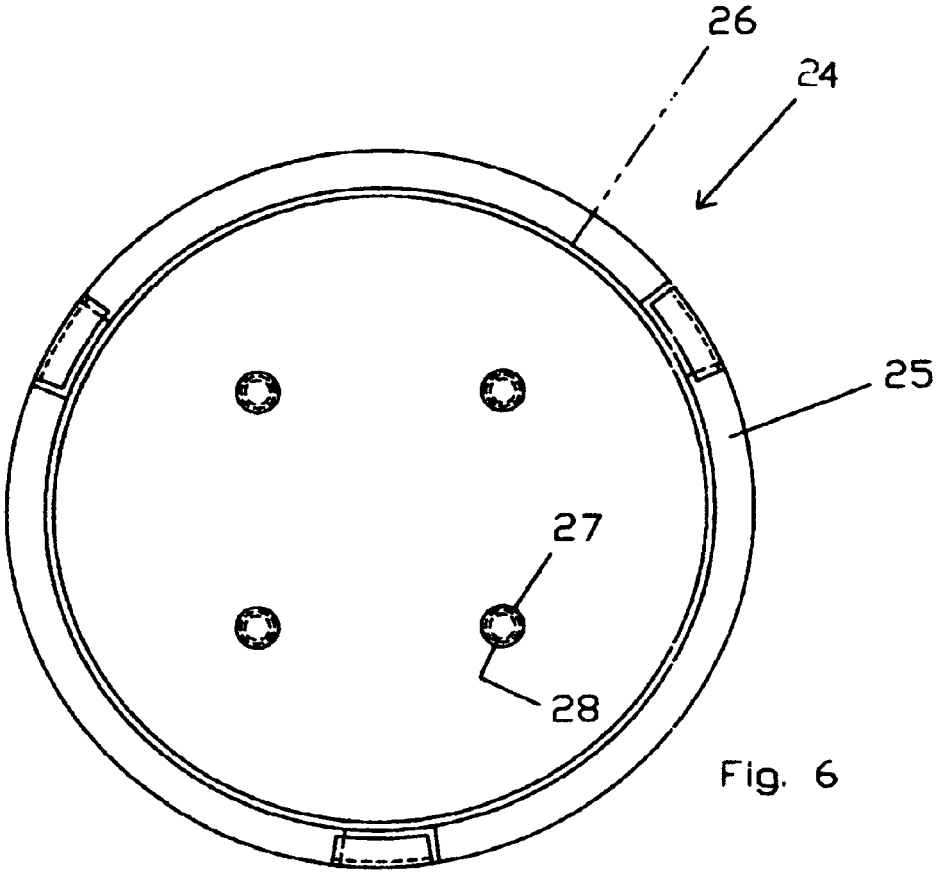
FIG. 6 is a top plan view of an alternate embodiment of a dispenser according to the present invention.
Figure 7:
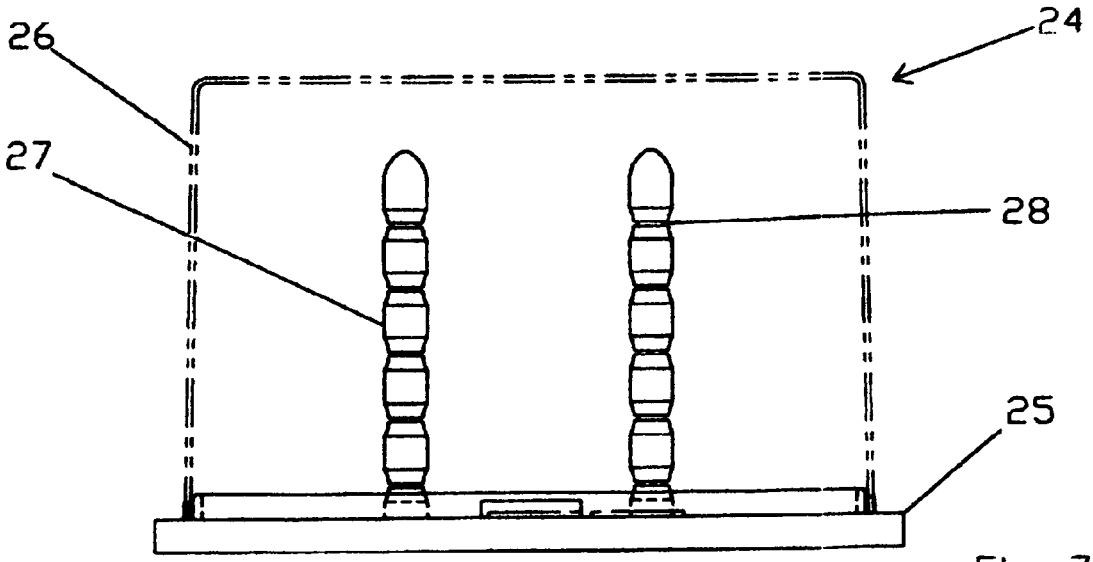
FIG. 7 is a front view of the dispenser of FIG. 6 with portions shown in broken lines.

Referring to FIGS. 6 and 7 of the drawings, there is shown therein a third preferred embodiment of a dispenser 24 according to the present invention. The dispenser 24 includes a base 25, a cover 26 shown in broken lines, a plurality of elongated guides 27, having notches 28 at spacings of approximately ⅜ inch. The base 25 and guides 27 may be molded, such as by injection molding a unitary base and guides out of a suitable material such as plastic. Each notch 28, is of a depth as to allow for easy removal of uppermost section by avulsion.

Figure 8:
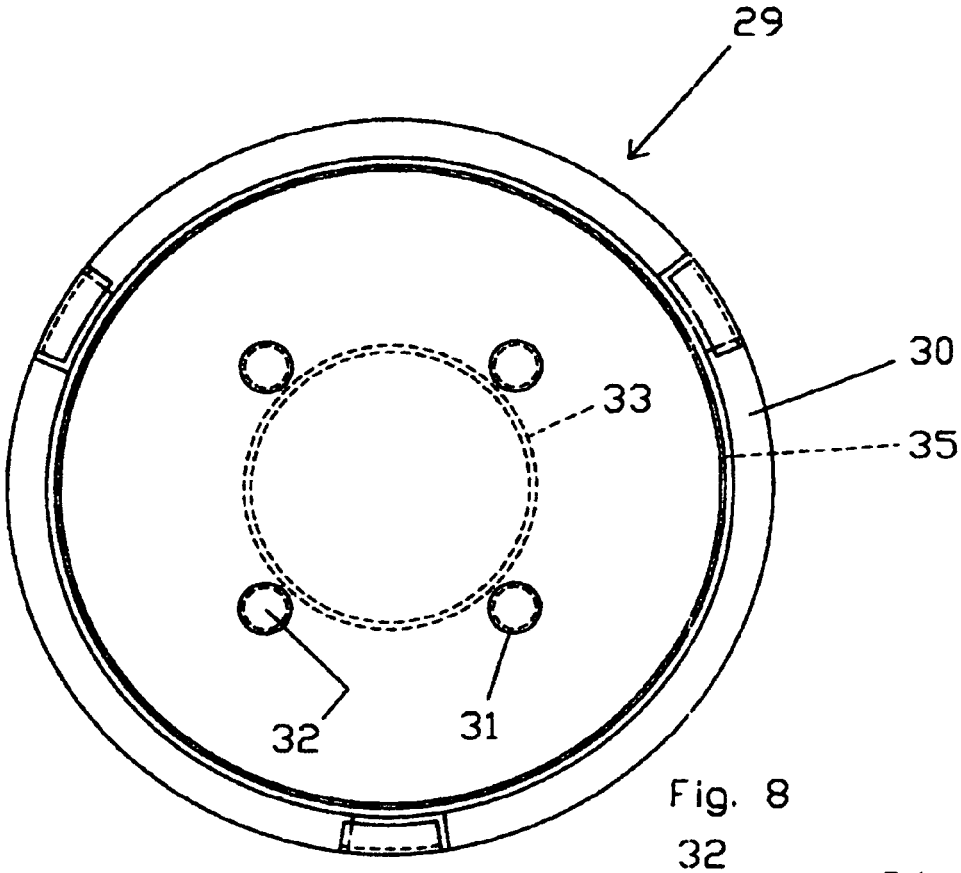
FIG. 8 is a top plan view of an alternate embodiment of the dispenser shown in FIG. 6 according to the present invention.
Figure 9:
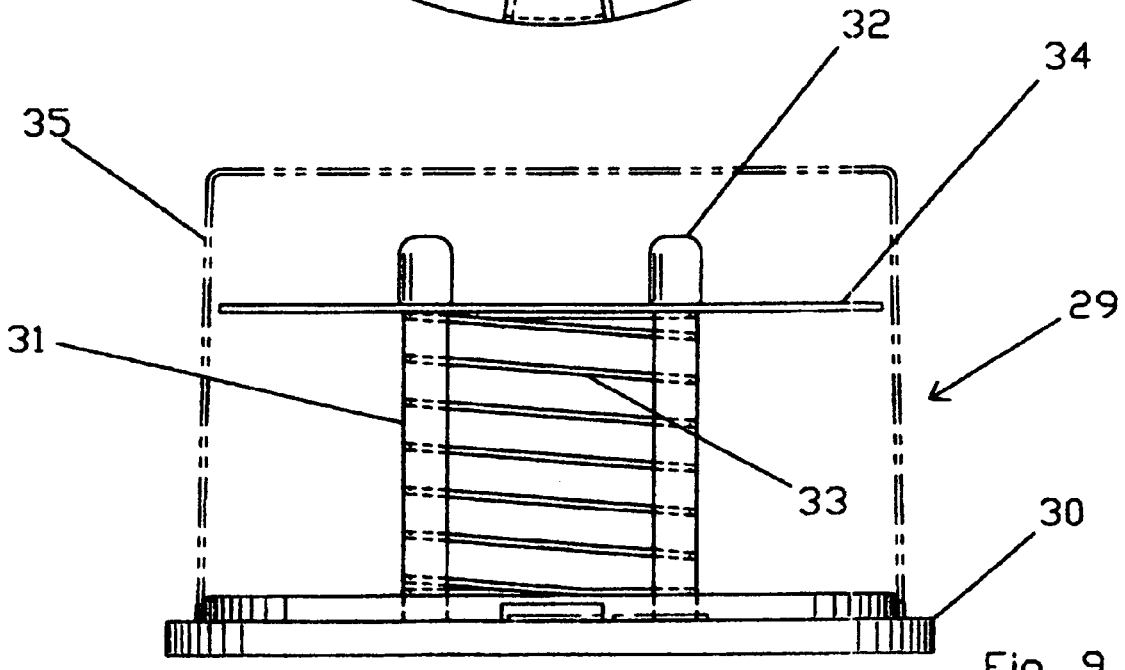
FIG. 9 is a front elevational view of the dispenser of FIG. 8.

Referring to FIGS. 8 and 9 of the drawings, there is shown therein a fourth preferred embodiment of a dispenser 29 according to the present invention. The dispenser 29 includes a base 30, guides 31 and enlarged tips 32, with a riser spring 33, riser plate 34, and protective cover 35. Base 30, riser guides 31, riser plate 34, and cover 35 can be molded out of a suitable material such as plastic. The enlarged tips 32 and riser guides 31 are of a two-piece design to allow installation of riser spring 33 and riser plate 34 during assembly. Riser spring 33 is of a coil type of sufficient size as to urge contents thereon (not shown) up to the enlarged tips 32.

Figure 10:
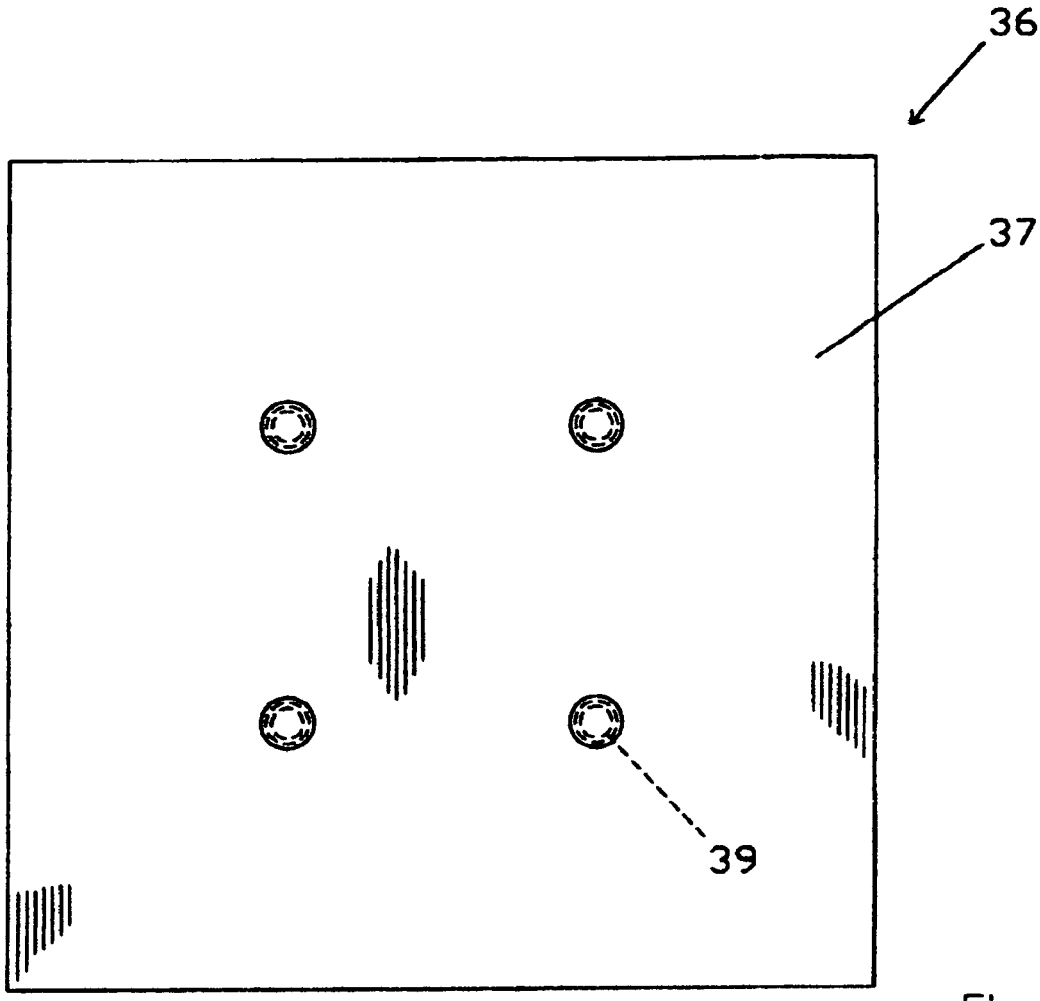
FIG. 10 is a top view of an alternate embodiment of a dispenser according to the present invention.
Figure 11:
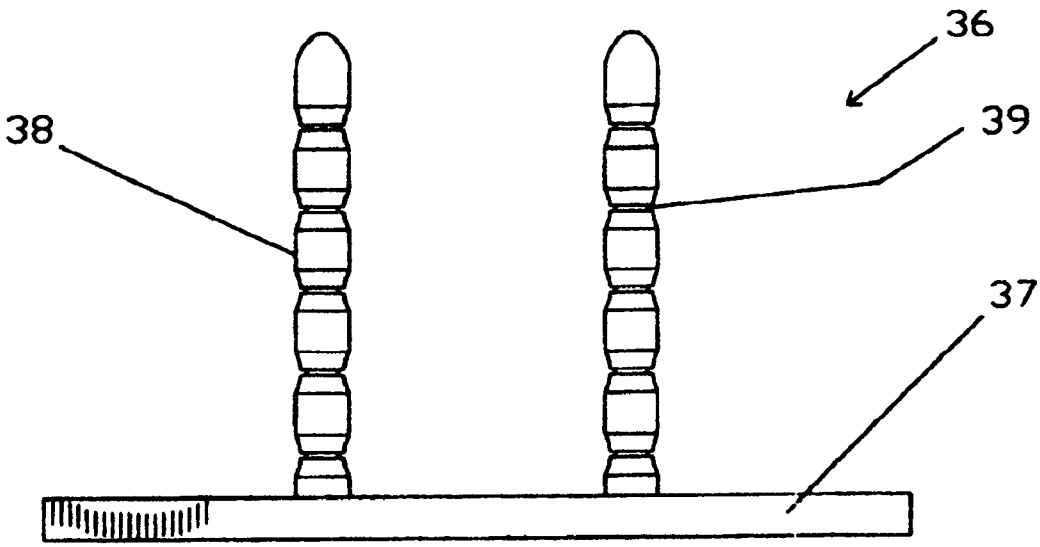
FIG. 11 is a front elevational view of the dispenser of FIG. 10.

Referring to FIGS. 10 and 11 of the drawings, there is shown therein a fifth preferred embodiment of a dispenser 36 according to the present invention. The dispenser 36 includes a base 37, and guides 38, and may be molded such as by injection molding of a suitable material such as plastic. Molded into the guides 38 at a predetermined spacing of approximately ⅜" are of a plurality of longitudinally spaced severing points at 39. The dispenser 36 is designed to be an inserted free accessory applicator for abrasive sheet packaging. The dimensions of base 37 are of such as to fit the package of the intended abrasive sheets 11. The height of guides 38 are of a length that permits the package top, not shown, to close as will be well understood by those skilled in the art.

Figure 12:
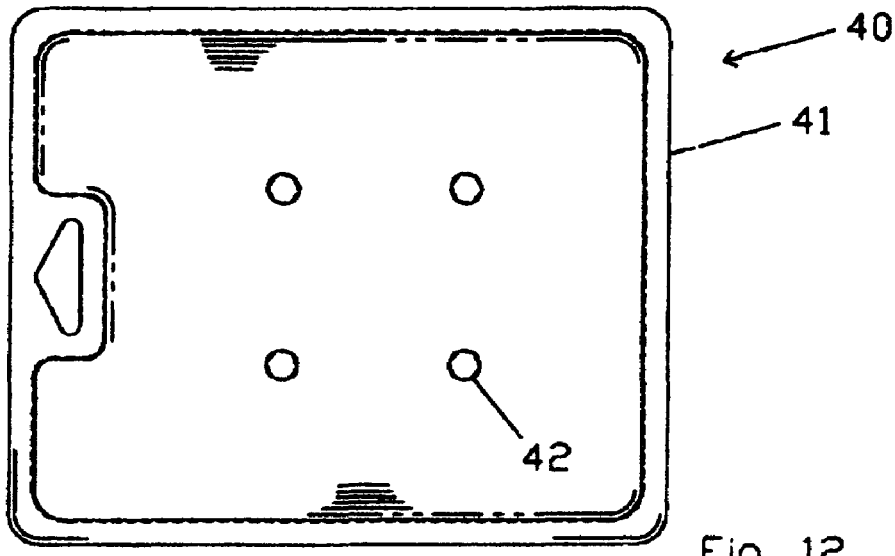
FIG. 12 is a top plan view of the cover of an alternate embodiment of a dispenser according to the present invention.
Figure 13:
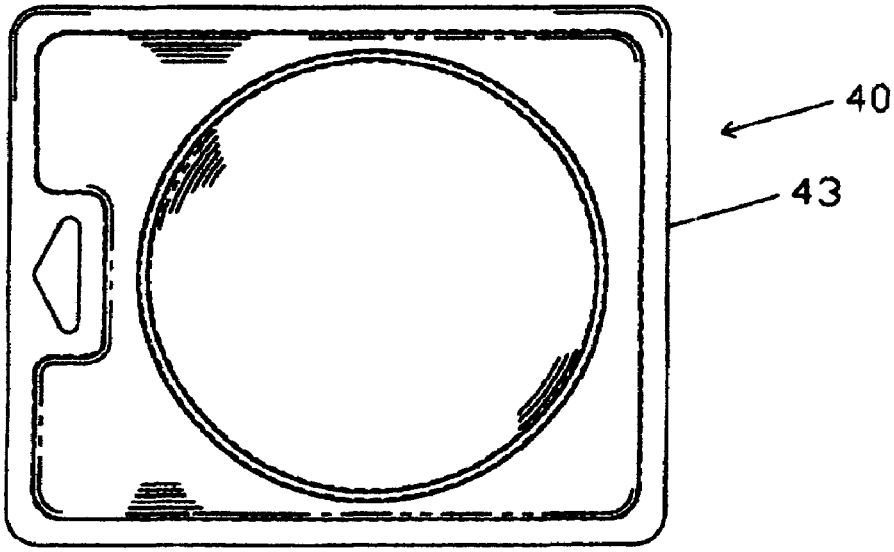
FIG. 13 is a top plan view of the container half of the dispenser of FIG. 12.
Figure 14:
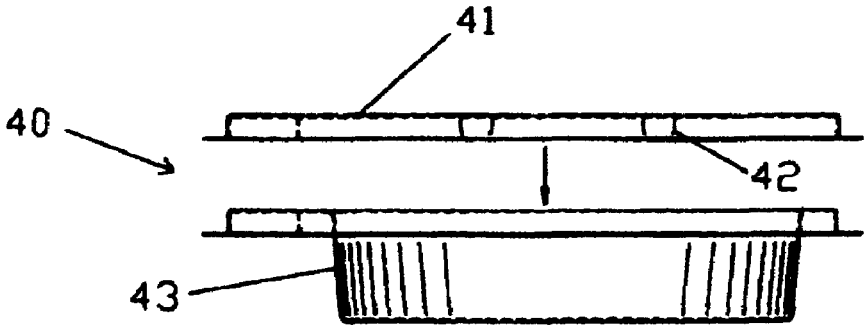
FIG. 14 is a side elevational assembled view of FIGS. 12 and 13.

Referring to FIGS. 12, 13 and 14 there is shown therein a sixth preferred embodiment of a dispenser 40 according to the present invention. The dispenser 40 includes a thermoformed unitary cover 41 and guides 42 and a thermoformed container 43 of a smooth, clear PETG material 0.015 mill thick. Coupling of the female cover 41 to the male container 43 creates the dispenser 40 package as seen in FIG. 14 of the drawings.

Figure 15:
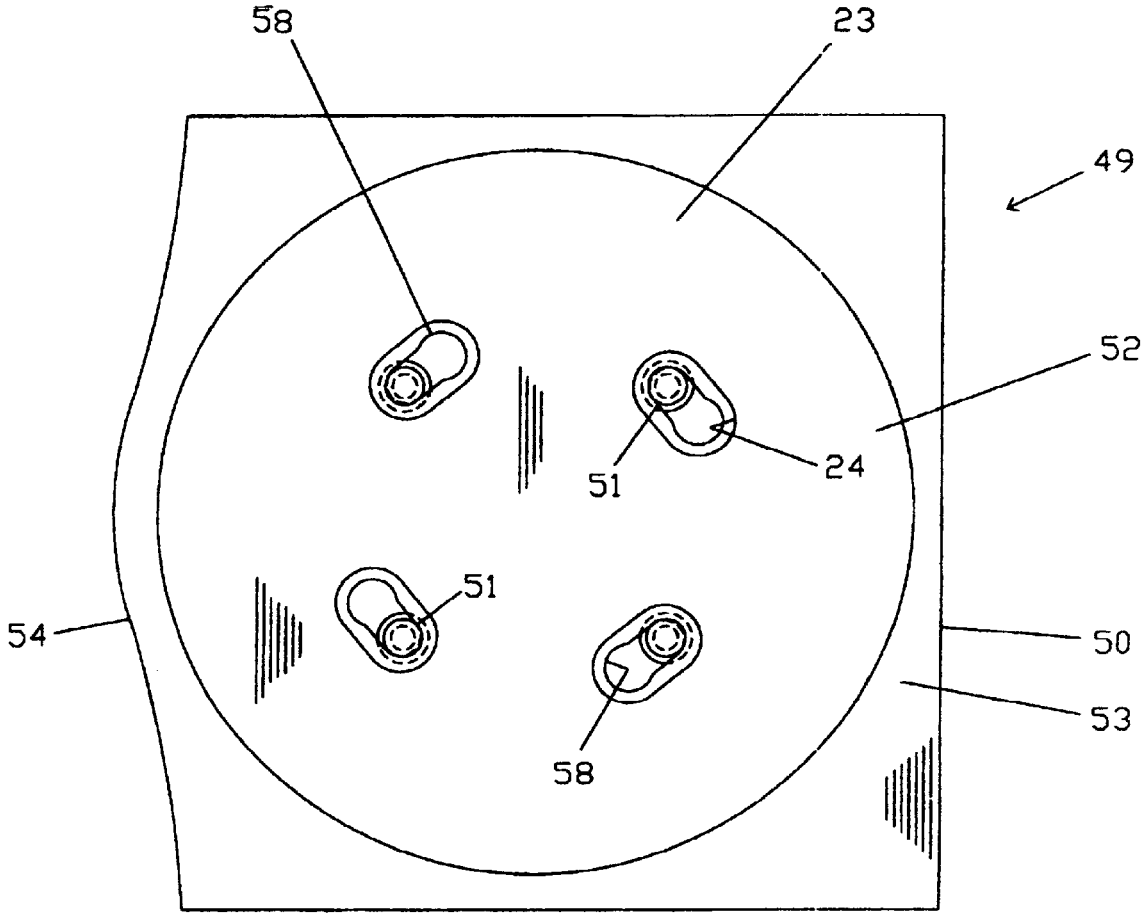
FIG. 15 is a top plan view of an alternate embodiment of a dispenser according to the present invention.
Figure 16:
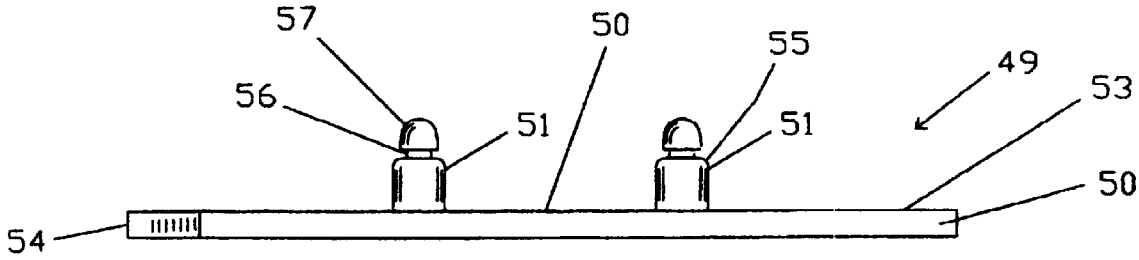
FIG. 16 is a side elevational view of dispenser of FIG. 15 with the cover plate removed for illustration purposes.
Figure 17:
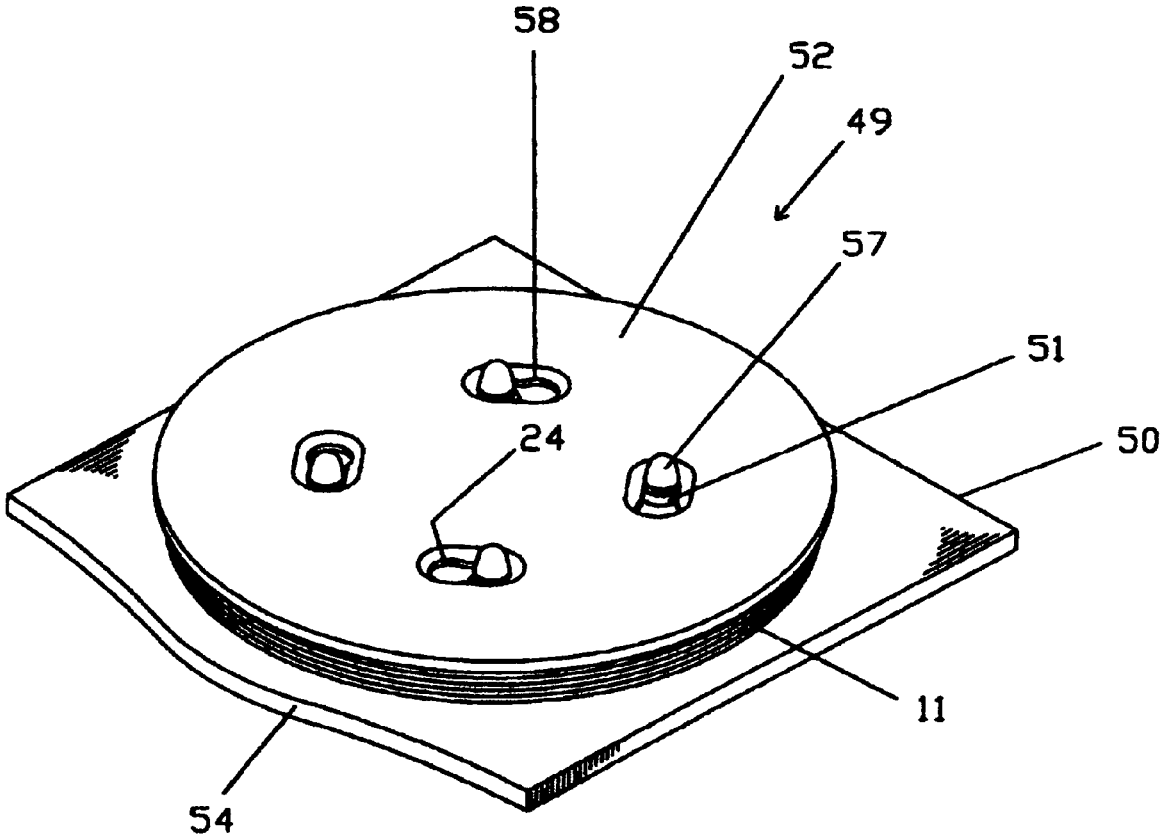
FIG. 17 is an isometric view of dispenser of FIGS. 15 and 16.

Referring to FIGS. 15, 16 and 17 of the drawings, there is shown therein a seventh preferred embodiment of a dispenser 49 according to the present invention. The dispenser 49 includes an injection molded unitary plastic base 50, and upstanding elongated guides 51, and an injection molded locking cover plate 52. Length and width of base 50 is determined by its intended abrasive sheet 11 and is ⅛th inch thick. An exposed outer periphery of base 50 is preferred for ease of holding dispenser stationary during use. The dispenser 49 has a curved front edge at 54, making base 50 attractive in appearance, and may be produced in a variety of colors to encourage easy grit identification. The position of guides 51 is determined by the intended abrasive sheet 11 to be dispensed as hereinbefore described.

The diameter of guides 51 is ⅜" and is of such as to fit snugly within the vacuum holes of its intended abrasive sheet without being restrictive. Guides 51 are ½" in height to the shoulder at 55. The guides 51 have a single annular notch at 56 to receive locking cover plate 52, and a smaller tip 57 above the notch at 56 that is approximately ¼ inch round and ¼ inch high. Locking cover plate 52 has tapered slots 58 equal to the number of guides 51. The cover plate 52 aligns with guides 51 and seats down onto shoulder at 55 thereof, level with notch at 56. Cover plate 52 is then rotated in one direction toward narrow end of tapered slot 58 locking the cover plate 52 in place. Cover plate 52 may be produced in a solid color or of clear acrylic.

Figure 18:
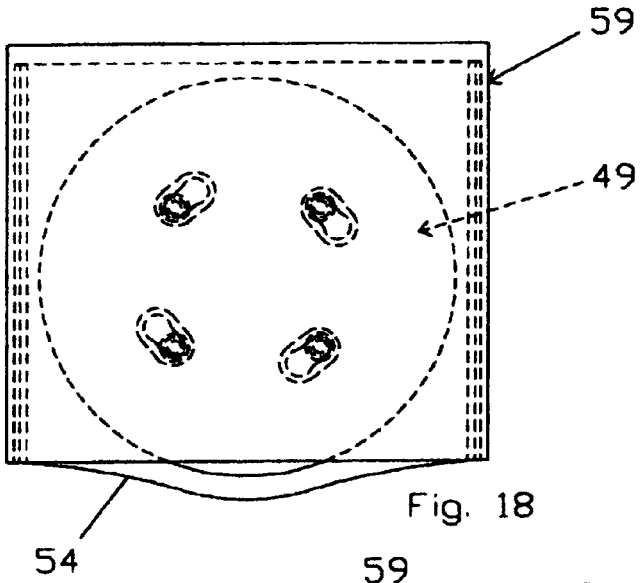
FIG. 18 is a top view of a multi-unit storage case containing a plurality of dispensers of FIG. 15.
Figure 19:
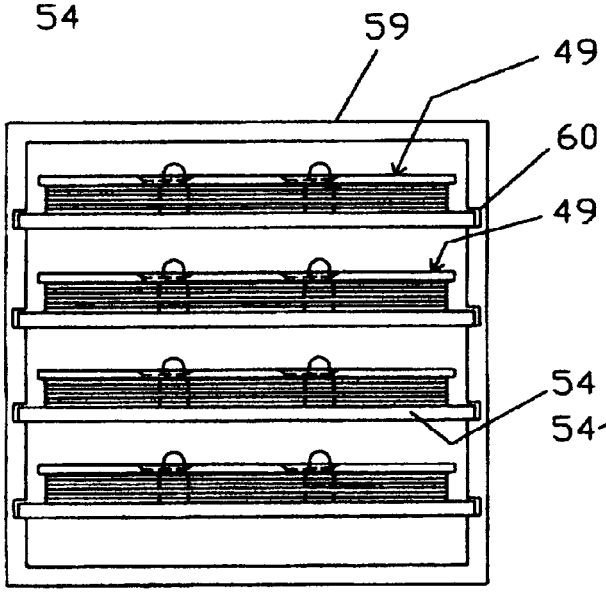
FIG. 19 is a front elevational view of multi-unit storage case of FIG. 18.
Figure 20:
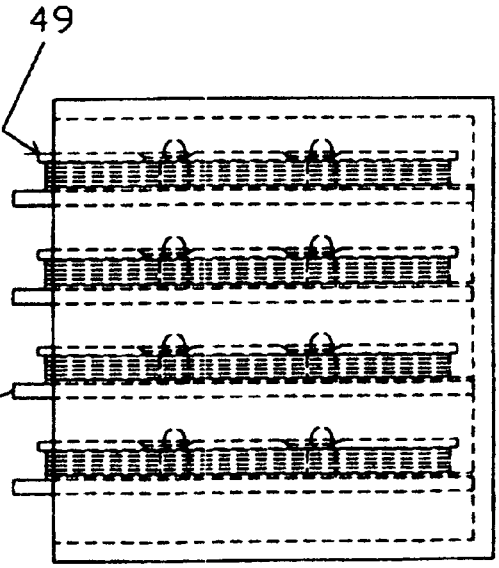
FIG. 20 is a side elevational view of multi-unit storage case of FIG. 19.

Referring to FIGS. 18, 19 and 20 of the drawings, there is shown therein an optional storage case 59. Storage case 59 is designed to hold four identical dispensers 49 of various colors therein. Storage case 59 can be an injection molded unitary plastic case or can be a manufactured wooden case. The dimensions are of such as to allow the curved front at 54 of each dispenser base 50 to project from the case front as seen in FIGS. 18 and 20 of the drawings. The curved front 54 then becomes a thumb-pull for removal therefrom and insertion into the storage case 59. Slots 60 are made into the respective sides of storage case 59 to act as a channel allowing dispenser base 50 to slide in and out.

Figure 21:
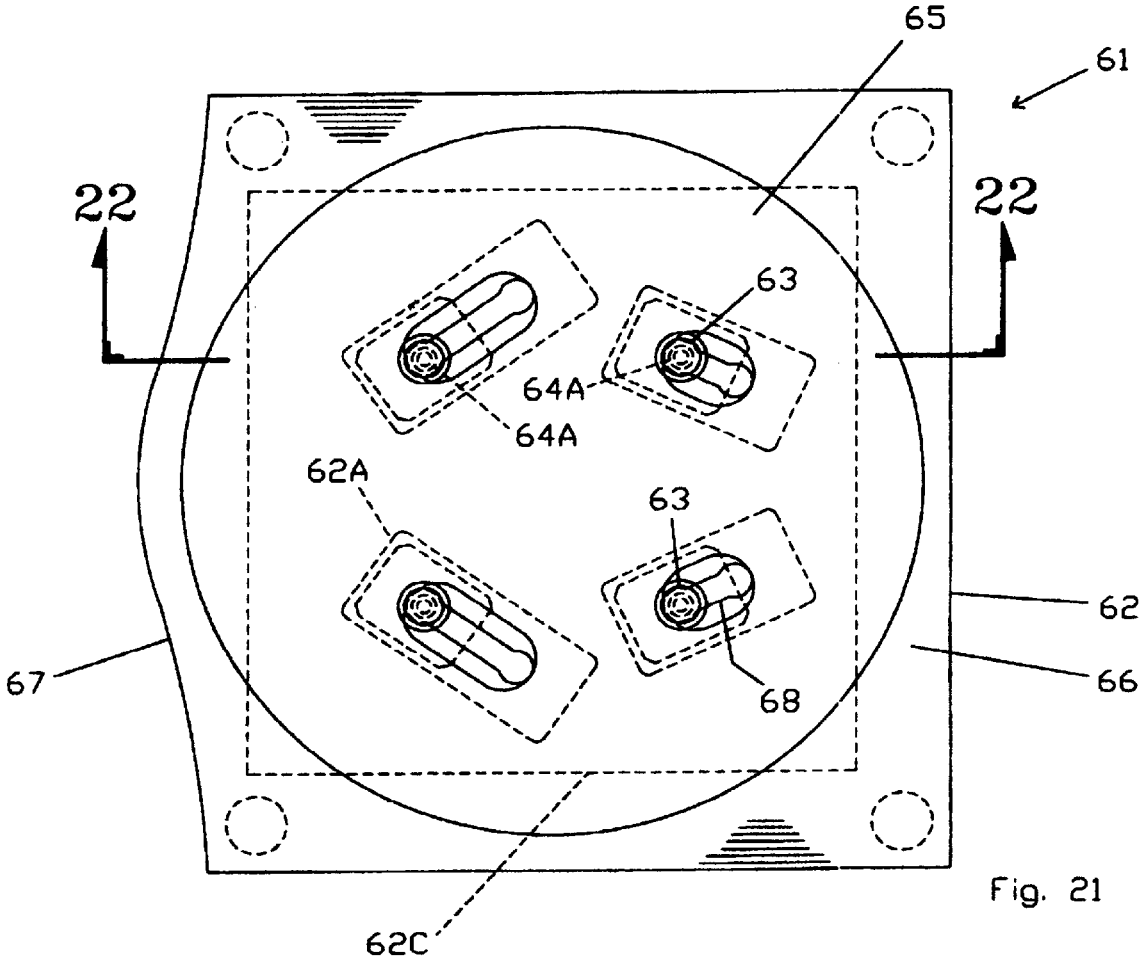
FIG. 21 is a top elevational view of another alternate embodiment of the dispenser according to the present invention.
Figure 22:
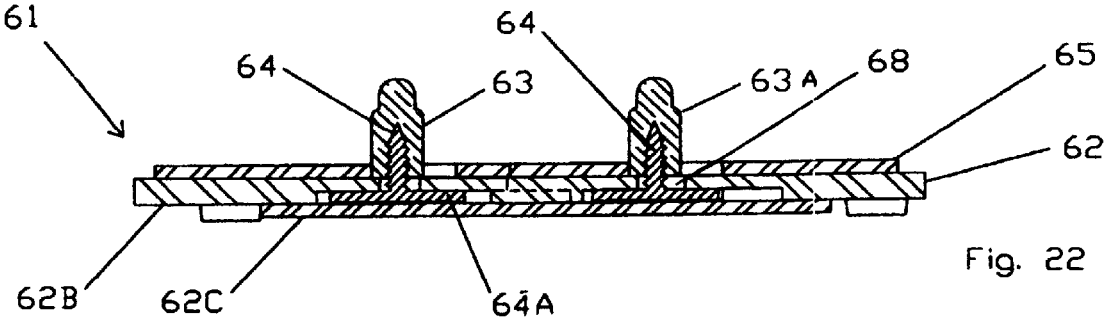
FIG. 22 is a sectional view on lines 22—22 of FIG. 21.

Referring to FIGS. 21 and 22 of the drawings, an eighth preferred embodiment of a dispenser 61 can be seen. The dispenser 61 includes a main injected molded universal base 62, multiple adjustable upstanding guides 63 having correspondingly engaging guide screws 64 and a clear acrylic universal cover plate 65 thereover. The base 62 has a plurality of rectangular molded recesses 62A within its lower surface 62B defining multiple guide tracks within. Each of the guide screws 64 has a flat head 64A which is slidably disposed within the corresponding guide track recesses 62A. A closure plate 62C is removably secured to the lower surface 62B of the base 62 capturing the aforedescribed screw head 64A within the guide tracks defined thereby. Contoured slots 68 are formed within portions 62A of the base 62 overlying the defined guide track recesses 62A. Each of the slots at 68 have oppositely disposed registration and enlargements for the guides 63. This allows the guides 63 to be slidably adjusted and locked in place by rotation thereof to match required pattern configurations as defined by the selected and desired abrasive sheets.

Universal cover plates 65 allows the abrasive sheets to be held in quantity thereon as will be apparent to those skilled in the art and described in greater detail hereinafter.

CONCLUSIONS, RAMIFICATIONS, AND SCOPE OF INVENTION

It will be seen that the dispenser of the invention provides a highly reliable, lightweight, yet economical device which simplifies alignment and attachment of vacuum-hole abrasive sheets. This invention also offers valuable assistance to persons with impaired vision as well as organizing the work area.

Using multiple dispensers allows several abrasive grits to be readily accessible. Using thermoformed packaging offers a unique opportunity to abrasive suppliers to make their product highly visible to the consumer, as well as including a desirable, inexpensive, and reliable alignment dispenser system. While my above description contains many specificities, these should not be construed as limitations on the scope of the invention, but rather as an exemplification of several of the preferred embodiments thereof. For example, abrasive sheets may be placed in a container having a plurality of guides in which the abrasive sheets may be lifted to the top by a means of one's thumb pushing a friction fit plunger up through a hole in the center of the container bottom, not shown.

In another embodiment, the above dispenser has threaded guides. The threaded guides are screwed into the top of a universal base at spaced locations and can be repositioned to receive various vacuum-hole abrasive sheet configurations. The elements of the above invention are not limited to being made from one type of material or process. For example, the guides may be of extruded plastic or machined from aluminum or steel, rather than of molded plastic. Thermoformed package, as seen in FIGS. 12, 13 and 14, can be made of PVC instead of PETG. Molded guides may be of a thinner diameter with an enlarged, round or flared tip, or as illustrated in FIGS. 6 and 7 of the drawings may have notched severing points at 28 with tapered tips. Notched guides 27 may be nutated at notches, unscrewed or pulled apart in sections. Dust cover 26 may be of a solid, transparent, or semi-transparent color. There may be one central riser spring 33, as shown in FIGS. 8 and 9 of the drawings, or a spring encompassing each guide 30. Base 12, universal base 62, locking cover plate 52 and universal cover plate 65, can be water cut or made with a CNC router system. Guides 30, 27 and 63 can be made on a CNC lathe or a Swiss turret lathe.

Height of containers, covers and guides of package and insert embodiments may vary to accommodate various numbers of abrasive sheets to be packaged. Insert dispenser may consist of a cardboard base 12 with wooden guides 13, stapled or glued on.

The term "abrasive sheet" as used herein including the claims, refers to any abrasive article to be attached to a backup pad. It is understood that the dispenser could be used with backup pads and abrasive sheets of any shape, such as triangle, square, circular, or other polygons which utilize vacuum hole dust collection. Thus, the scope of the present invention should not be limited to the exact details and structures described herein, but rather by the structures described by the language of the claims, and the equivalents of those structures.

OPERATION OF THE INVENTION

To operate user-loaded embodiments simply place a dispenser of the invention on a work surface. With abrasive grit down, align the vacuum holes of a plurality of abrasive sheets with the guides of the dispenser and lower sheets fully down on to guides. Repeat this process until approximately ⅛$^{th}$ " of guides are left exposed. With abrading tool in right hand remove worn abrasive sheet. Place abrading tool, not shown, over dispenser and center backup pad, not shown, with top sheet and manually rotate backup pad while allowing slight contact with guide tips. Vacuum holes of pad will find guides of dispenser. Seat the backup pad down onto the top abrasive sheet allowing full contact. Place two fingers of left hand on exposed outer periphery of dispenser to hold stationary. Lifting abrading tool removes top abrasive sheet. The abrasive sheet is automatically centered and the vacuum holes aligned. Repeat the process as needed.

The manner of operation of the dispenser of the invention is not found in prior art abrasive sheet dispensers. The dispensers of FIGS. 1 through 22 perform the same function. However, the dispenser shown in FIGS. 1, 2, and 3 is designed to be a disposable insert included in abrasive packaging. The dispenser of FIGS. 4 and 5 has spring-loaded guides which retract under slight downward pressure allowing a backup pad with shallow vacuum holes to seat fully to the base. The spring-loaded guides can also be longer, allowing for more abrasive sheets.

The dispenser shown in FIGS. 6 and 7 is designed to be the shipping container in which a plurality of abrasive sheets 11 are pre-loaded at the factory, shipped and sold. To operate, unlock protective cover 26 from base 25 and remove. As the abrasive sheets 11 are used the tips of guides 27 are exposed hindering contact of the backup pad onto the top abrasive sheet 11. Simply nutate tip and remove by avulsion at uppermost notch 28, of each guide 27 allowing a new contact point for several abrasive sheets. Repeat this process until all the abrasive sheets have been used. The dispenser is then disposed of and a new one purchased.

The dispenser shown in FIGS. 8 and 9 is designed to be reusable and is loaded by the user with up to fifty abrasive sheets 11, not shown. When fully loaded the weight of abrasive sheets causes riser plate 34 to retract to base 30 collapsing riser spring 33.

As abrasive sheets are removed, riser spring 33 causes riser plate 34 to gradually lift abrasive sheets to base of enlarged tips 32 of riser guides 31. The exposed wider tips 32, acts as a riser stop for riser plate 34. Protective cover 35 is placed over and locked down unto base 30 when not in use preventing exposure to dust and moisture.

The dispenser 36 shown in FIGS. 10 and 11 of the drawings is designed to be preloaded at the factory with abrasive sheets, not shown, and placed within the package used by abrasive companies and sold to the consumer. The user opens the package and lifts out the contents, placing them on the work surface. From there, the function is virtually the same as the dispenser of FIGS. 6 and 7. As the abrasive sheets are removed the tips of guides 38 are exposed eventually hindering contact of the backup pad unto the top abrasive sheet. Simply nutate tips and remove by avulsion at upper notch 39, of each guide 38 allowing a new contact point for several abrasive sheets. Repeat this process until all the abrasive sheets have been used. Dispenser 36 may be stored in original container when not in use. Entire unit is disposed of when empty and a new one purchased.

The dispenser 40 as seen in FIGS. 12, 13 and 14 of the drawings is designed to be a factory loaded thermoformed package, and is also designed to be hung on a commercial display. The consumer buys a chosen grit and number of desired abrasive sheets. The user places the dispenser 40's container 43 down, on work surface and lifts off dispenser cover 41 with guides 42, placing cover 41, guides up, on a flat surface. The user then removes several abrasive sheets from container and places them, grit down, over guides 42. The user then places abrading tool, not shown, over dispenser 40 and aligns guides 42 with vacuum holes in backup pad by slightly rotating backup pad. The backup pad is then seated unto top abrasive sheet, making full contact. With several fingers holding dispenser stationary, the user then lifts abrading tool, removing top abrasive sheet. The abrasive sheet is automatically centered and the vacuum holes aligned. Dispenser cover 41 is reattached to container when not being used and package may be stored on a hook.

The dispenser 49 as seen in FIGS. 15, 16 and 17 of the drawings is designed to be durable and reusable. The dispenser 49 is placed on a bench top. The user identifies the desired grit by that dispenser's particular color. For first time loading, the user rotates and removes locking cover plate 52. The user then places a desired number of abrasive sheets, not shown, grit down over guides 51, and fully to base 50. Dispenser 49 is loaded when ⅛ inch of tip 57 of guide 51 is left exposed. To store, align tapered slots 58 of cover plate 52 with guides 51. Press cover plate 52 down to shoulder 55, of guide 51, slightly compressing abrasive sheets and rotate into notches 56 of guides 51, locking same in place.

The dispenser 49 can be sold as a single unit or as an option purchased as a set of four included in a multi-unit storage case 59 as seen in FIGS. 18, 19 and 20. To use, the user places multi-unit storage case 59 on a workbench top, chooses a grit by the dispenser's color and removes that dispenser 49 by pulling out on arched thumb pull 54 extended beyond case front. The dispenser is then placed on bench top and user rotates and removes cover plate 52, temporarily placing same inside bottom of storage case 59. Abrading tool, not shown, is placed over dispenser 49 and guides 51 are aligned with vacuum holes in backup pad by slight rotation of backup pad while allowing slight contact with guide tips 57. Abrading tool, not shown, is then seated fully unto top abrasive sheet. Lifting abrading tool removes top abrasive sheet. The abrasive sheet is automatically entered and vacuum holes aligned. This process is repeated as needed. User then retrieves cover plate 52 from bottom of storage case 59 and locks in place unto dispenser 49, keeping remaining abrasive sheets flat and protected. The dispenser 49 is then returned to the multi-unit storage case 59.

The dispenser 61 as seen in FIGS. 21 and 22 of the drawings is designed to be interchangeable between more than one vacuum-hole pattern and is also designed to be adjustable between various abrasive brands within a vacuum-hole pattern. It can also be designed to be interchangeable with more than one diameter of abrasive sheet. For first time loading, the user removes the universal cover plate 65. The user than determined the required guide aperture pattern, then adjust the guides 63 by rotation of same, repositioning the guides within the guide slots 68 as hereinbefore described. With guides 63 still loose, the desired grit abrasive sheets are then stacked hook and loop surface, not shown, up until even with the shoulder 63A.

The guides 63 are then tightened locking in the desired guide 63 position. The universal cover plate 65 is then placed over the stacked abrasive sheets to prevent sheets from curling and collecting dust.

The dispenser 61 can be sold as a single unit or as an option purchased as a set of four included in a multi-unit storage case, (shown FIGS. 18, 19 and 20 of the drawings).

The invention claimed is:

1. A dispenser for abrasive sheets having vacuum holes within comprises, a sheet support base, a plurality of upstanding guides extending from said support base, said guides in spaced planar relationship to one another for alignment with corresponding apertures in said abrasive sheets, said guide having an area of reduced transverse dimension inwardly from their respective free ends said support base of a known dimension equal to or greater than that of said abrasive sheet supporting same contoured slots overlying guide tracks in said support base guide screws in said guide tracks extending through said contoured slots engaging said respective guides thereabove and means for selectively securing multiple abrasive sheets in stacked alignment on said guides.

2. The dispenser set forth in claim 1 further include, guide tracks in said support base for said selective guide screws.

3. The dispenser set forth in claim 1 further include, guide tracks in said support base for said selective guide screws.

4. The dispenser set forth in claim 1 wherein said means for selectively securing multiple abrasive sheets in stacked alignment on said guides comprises, a locking cover plate having contoured openings within for corresponding registration over with and onto said guides.

* * * * *